US006635832B1

(12) United States Patent
Oster et al.

(10) Patent No.: US 6,635,832 B1
(45) Date of Patent: Oct. 21, 2003

(54) ELECTRICAL SWITCH

(75) Inventors: Christoph Oster, Lüdenscheid (DE); Martin Wagner, Lüdenscheid (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 146 days.

(21) Appl. No.: 09/360,936

(22) Filed: Jul. 26, 1999

(30) Foreign Application Priority Data

Sep. 28, 1998 (DE) ..... 198 44 336

(51) Int. Cl.[7] ..... H01H 19/00; H01H 21/00

(52) U.S. Cl. ..... 200/6 A; 200/4; 200/5 R; 200/17 R; 200/18

(58) Field of Search ..... 200/4, 5 R, 6 R, 200/6 A, 17 R, 18, 332, 335, 339

(56) References Cited

U.S. PATENT DOCUMENTS

| | | | | |
|---|---|---|---|---|
| 4,408,103 A | * | 10/1983 | Smith, III | 200/6 A |
| 4,473,725 A | * | 9/1984 | Kim | 200/6 A |
| 5,508,479 A | * | 4/1996 | Schooley | 200/5 R |
| 5,619,021 A | * | 4/1997 | Yamamoto et al. | 200/6 A |
| 5,619,195 A | * | 4/1997 | Allen et al. | 341/20 |
| 5,731,558 A | * | 3/1998 | Kyoden | 200/5 R |
| 5,883,346 A | * | 3/1999 | Stucken | 200/4 |

FOREIGN PATENT DOCUMENTS

| | | | |
|---|---|---|---|
| DE | 39 30 754 C1 | 4/1991 | H01H/25/04 |

* cited by examiner

*Primary Examiner*—Elvin Enad
(74) *Attorney, Agent, or Firm*—Brooks & Kushman P.C.

(57) ABSTRACT

An electrical switch including a housing, four fixed contact elements fixed with respect to the housing, and four movable contact elements movable with respect to the housing. Each of the movable contact elements is positioned directly opposite from a respective fixed contact element. An actuating member is movable from a neutral position into four actuating positions. In each actuating position the actuating member actuates a respective movable contact element causing the respective movable contact element to contact a respective fixed contact element for enabling a corresponding switching function. An auxiliary frame surrounds the actuating member and is positioned within the housing. A first pair of opposed connecting elements connects the actuating member to the auxiliary frame. The first pair of opposed connecting elements form a first pivot axis. A second pair of opposed connecting elements connect the auxiliary frame to the housing. The second pair of opposed connecting elements are disposed offset by 90° with respect to the first pair of opposed connecting elements. The second pair of opposed connecting elements form a second pivot axis. The actuating member moves from the neutral position into one of the four actuating positions about the first and second pivot axes.

6 Claims, 5 Drawing Sheets

Fig. 3
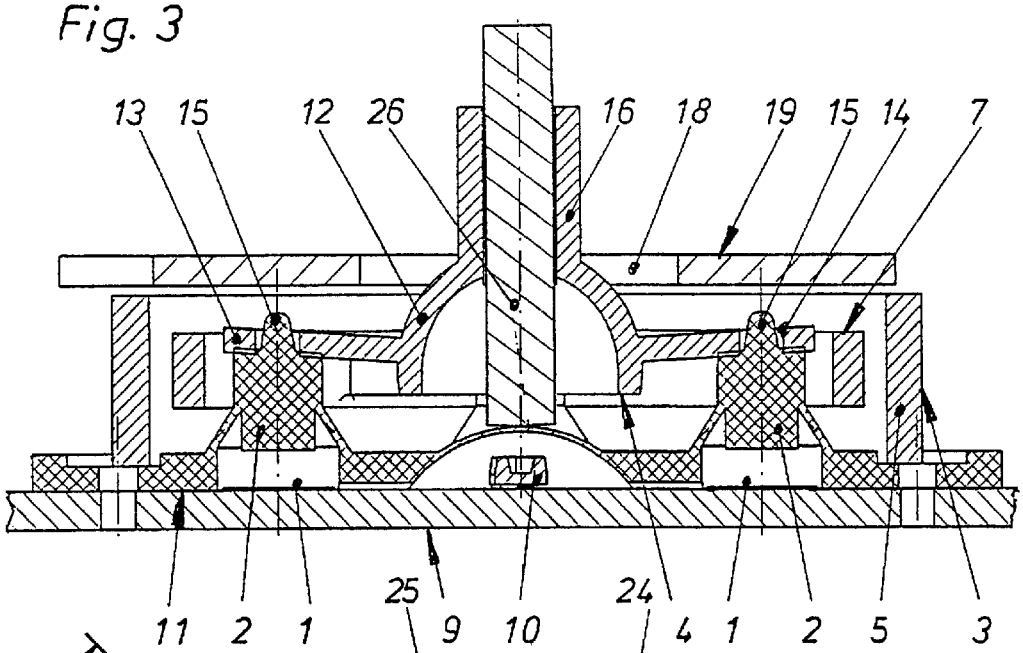
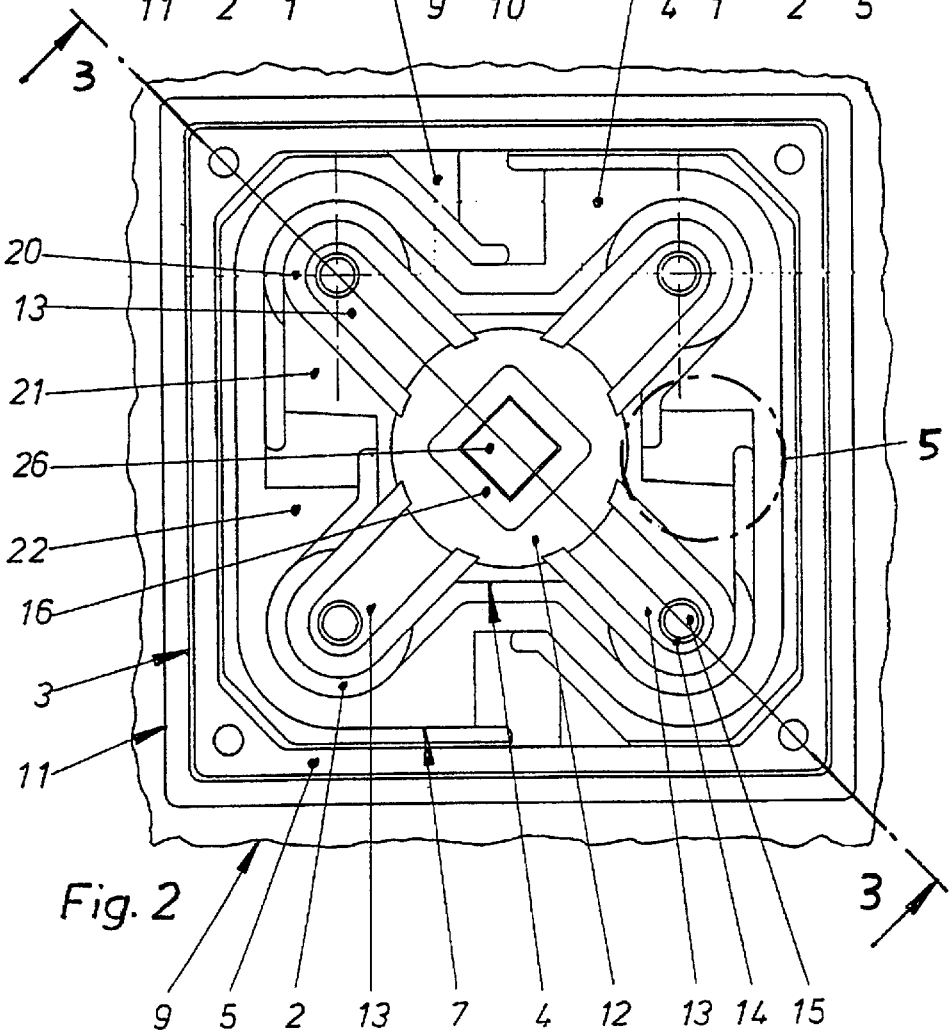
Fig. 2

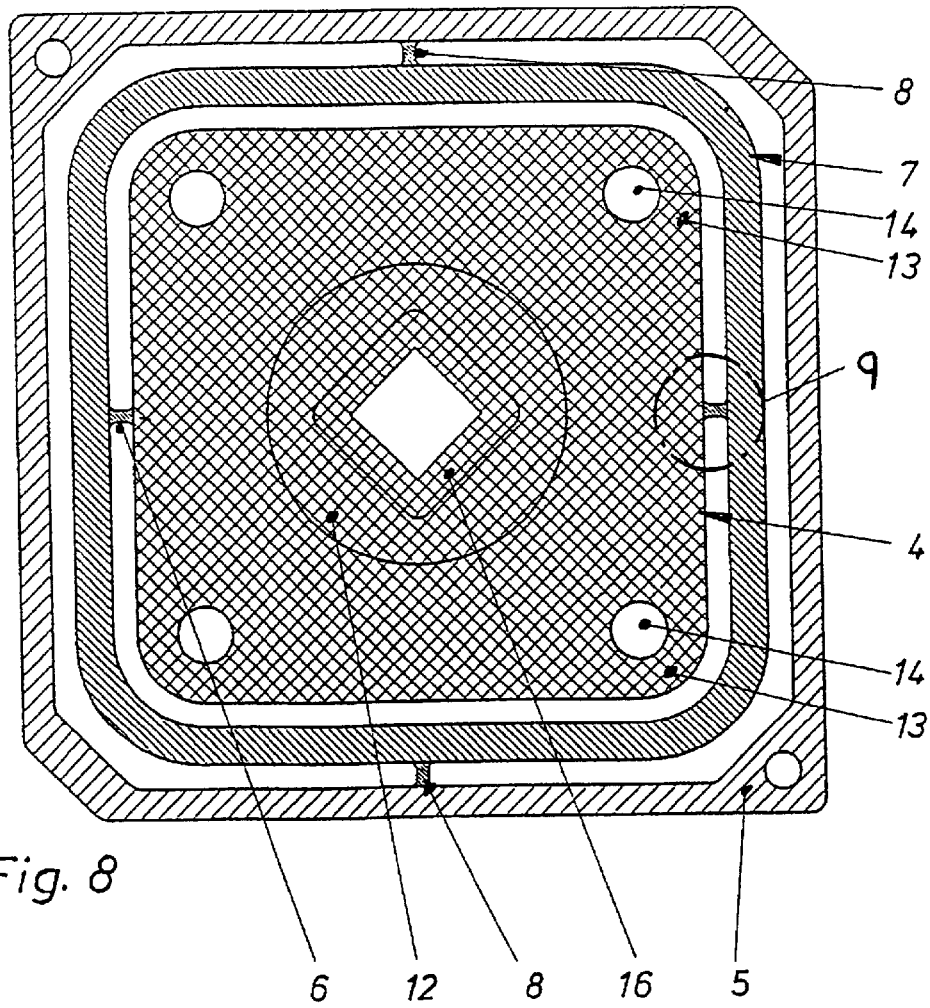
Fig. 8
Fig. 5
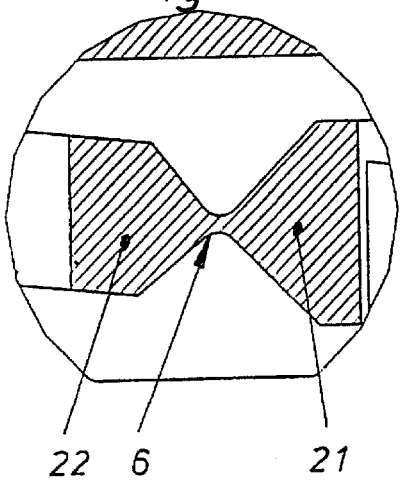
Fig. 9
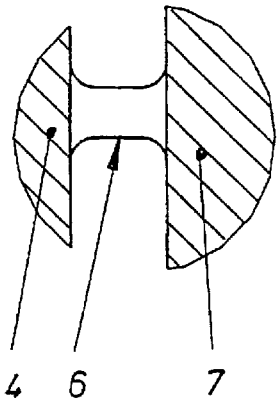

ELECTRICAL SWITCH

TECHNICAL FIELD

The present invention relates generally to an electrical switch having an actuating member movable about first and second pivot axes from a neutral position into four actuating positions.

BACKGROUND ART

Electrical switches switch on and off circuits and switch between circuits. Electrical systems have many different type of contact systems. Some electrical switches have an actuating member which is pivoted to actuating positions to enable functions associated with the actuating positions to be performed. For example, the actuating member is pivoted to adjust the position of a rear view mirror, a seat part, etc., in a motor vehicle. Starting from a neutral position, the actuating member may be movable between four defined actuating or functional positions.

DE 39 30 754 C1 discloses a four way electrical switch having an actuating member with four actuating elements in a housing. Each of the four actuating elements are associated with a respective movable contact element. Each of the four movable contact elements are associated with a respective fixed contact element. The fixed contact elements are fixed to the housing. Moving the actuating member to one of the four actuating positions causes an actuating element to contact its associated movable contact element. In response, the movable contact element contacts its associated fixed contact element and completes a circuit to enable a switching function. The actuating elements are combined in one piece forming an actuating ring. The actuating ring surrounds and is concentric to the actuating member. A problem with the electrical switch of DE 39 30 754 C1 is that the actuating member, the actuating ring, and the housing are individual parts which are produced separately. After production, these individual parts are assembled according to their respective functions.

DISCLOSURE OF INVENTION

Accordingly, it is an object of the present invention to provide an electrical switch of the type mentioned in the introduction having fewer individual parts which are conveniently produced and require minimum assembly outlay.

In carrying out the above object and other objects, the present invention provides an electrical switch. The electrical switch includes a housing, four fixed contact elements fixed with respect to the housing, and four movable contact elements movable with respect to the housing. Each of the movable contact elements is positioned directly opposite from a respective fixed contact element. An actuating member is movable from a neutral position into four actuating positions. In each actuating position the actuating member actuates a respective movable contact element causing the respective movable contact element to contact a respective fixed contact element for enabling a corresponding switching function.

An auxiliary frame surrounds the actuating member and is positioned within the housing. A first pair of opposed connecting elements connects the actuating member to the auxiliary frame. The first pair of opposed connecting elements form a first pivot axis. A second pair of opposed connecting elements connect the auxiliary frame to the housing. The second pair of opposed connecting elements are disposed offset by 90° with respect to the first pair of opposed connecting elements. The second pair of opposed connecting elements form a second pivot axis. The actuating member moves from the neutral position into one of the four actuating positions about the first and second pivot axes.

Many advantages are associated with the present invention. For instance, a single piece housing having an actuating member with a plurality of actuating regions is convenient to produce.

The above object and other objects, features, and advantages of the present invention are readily apparent from the following detailed description of the best mode for carrying out the present invention when taken in connection with the accompanying drawings.

BRIEF DESCRIPTION OF DRAWINGS

FIG. 2 illustrates a plan view of the electrical switch without a housing cover;

FIG. 3 illustrates a sectional view of the electrical switch along the line 3–3 of FIG. 2;

FIG. 5 illustrates an enlarged partial sectional view of the circled area 5 of FIG. 2 in a deflected-out state;

FIG. 8 illustrates an enlarged plan view of the housing base of the electrical switch in accordance with the third embodiment marking individual components with different types of shading; and FIG. 9 illustrates an enlarged partial sectional view of the circled area 9 of FIG. 7.

BEST MODE FOR CARRYING OUT THE INVENTION

Figure 1:
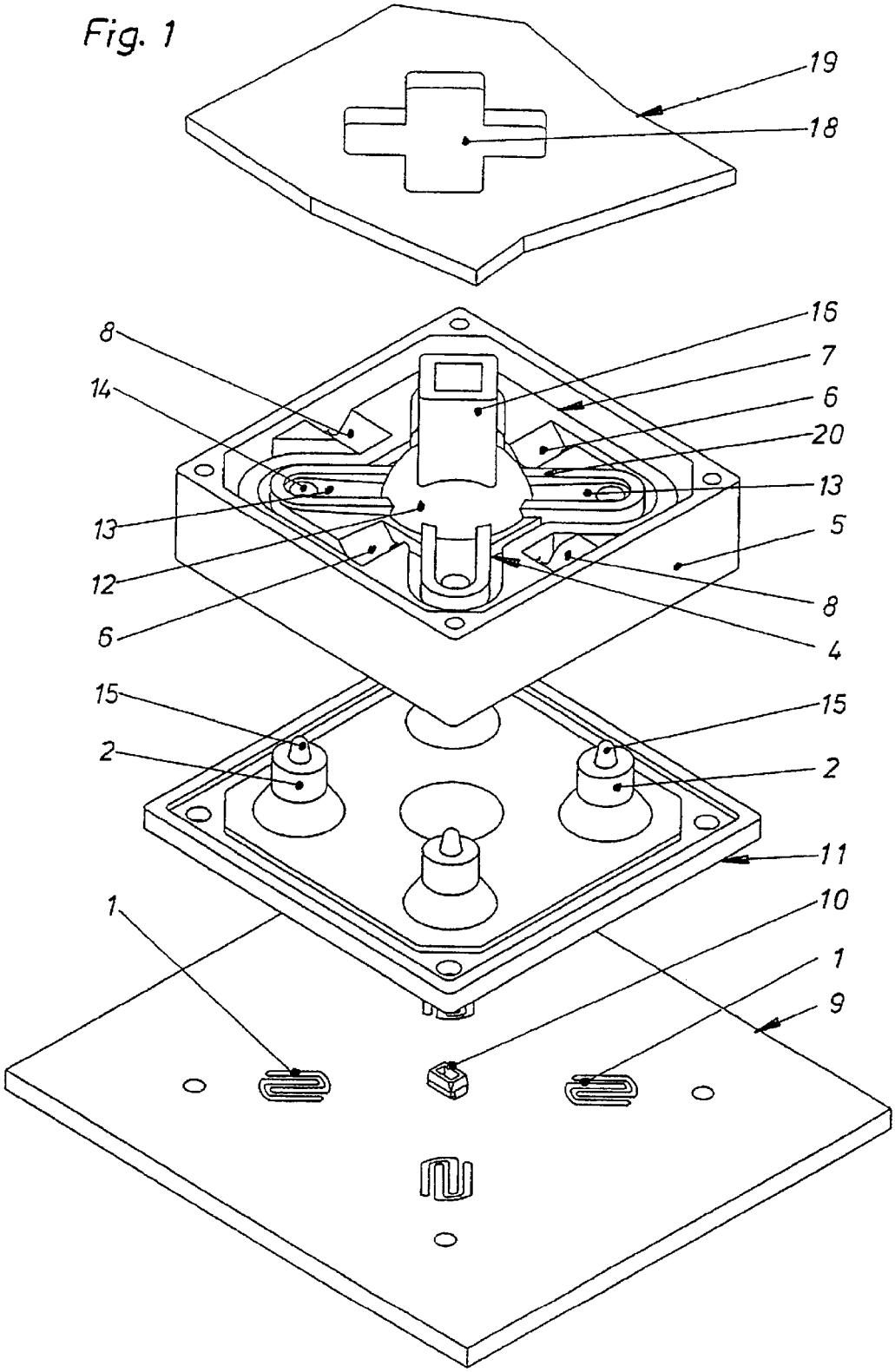
FIG. 1 illustrates an exploded view of the electrical switch in accordance with a first embodiment of the present invention.

Referring now to FIGS. 1–5, an electrical switch in accordance with a first embodiment of the present invention is shown. The electrical switch includes a housing 3 having fixed contact elements 1 and movable contact elements 2. Each of movable contact elements 2 is associated with a respective fixed contact element 1. At least one actuating member 4 is displaceable held on housing 3. Starting from a neutral position, actuating member 4 is movable crosswise to at least four defined functional or actuating positions. Actuating member 4 actuates a movable contact element 2 in an actuating position. In response to being actuated, the movable contact element 2 contacts the respective fixed contact element 1 thereby enabling a switching function.

Housing 3 further includes a housing base 5 having actuating member 4. An auxiliary frame 7 positioned within housing 3 surrounds actuating member 4. Two opposite lying, first connecting elements 6 each connect actuating member 4 in one piece to an auxiliary frame 7. First pair of connecting elements 6 form a first pivot axis. Two opposite lying, second connecting elements 8 each connect auxiliary frame 7 in one piece to housing base 5 of housing 3. The second connecting elements 8 are disposed offset by 90° with respect to the two first connecting elements 6. The second pair of connecting elements 8 form a second pivot axis. The first and second connecting elements 6, 8 are each flexible to enable an exact displacement of actuating member 4 about the pivot axes. The first and second connecting elements 6, 8 are each disposed offset by 45° with respect to the displacement direction of actuating member 4 to the four actuating positions.

All four connecting elements 6, 8 rotate simultaneously as actuating member 4 moves. Simultaneous rotation produces for each individual connecting element 6, 8 a low degree of rotation because the pivot angle of actuating member 4 required for achieving each of the four functional positions is divided up amongst all four connecting elements 6, 8. Lower loading of the first and second connecting elements 6, 8 enables the electric switch to have a comparatively long life.

Fixed contact elements 1 are disposed on a printed circuit board 9. Printed circuit board 9 includes at least one light emitting diode (LED) 10 for illuminating the electrical switch. Fixed contact elements 1 are disposed on the main surface of printed circuit board 9 facing actuating member 4. A dome switching mat 11 lies on the main surface of printed circuit board 9. Dome switching mat 11 has four dome switching contacts each lying opposite to a respective movable contact element 2. A dome switching contact contacts an associated fixed contact element 1 when actuating member 4 moves to an actuating position and actuates a movable contact element 2. For each direction of actuation of actuating member 4, one fixed contact element 1 and one movable contact element 2 combine to form one functional group having a corresponding switching function.

Printed circuit board 9 forms a support base for housing 3. For this reason, printed circuit board 9 also includes the fixed contact elements required for the connection. The contact points provide direct connection to a plug-in contact part connected to an associated network structure. Printed circuit board 9 can also be formed such that a plurality of electrical switches are produced in desired arrangements using a single printed circuit board. If a fully-housed electrical switch is required, then printed circuit board 9 may be fixed to a dedicated support base. With a dedicated support base, printed circuit board 9 can be a flexible conductor foil.

Actuating member 4 includes a spherical shaped central region 12. Four actuating regions 13 are integrally formed on central region 12. The four actuating regions 13 contact a respective movable contact element 2 of dome switching mat 11 when actuating member 4 moves to an actuating position and actuates the respective movable contact element.

The four actuating regions 13 each have a cut-out 14. Movable contact elements 2 each have a projection 15 provided in one piece. When actuating member 4 moves to an actuating position causing an actuating region 13 to actuate a movable contact element 2, projection 15 of the movable contact element engages into cut-out 14 of the actuating region. To perform the deflection of movable contact elements 2 appropriate for functional purposes, the dome switching contacts are chamfered on their head surface in the direction of central region 12. This enables movable contact elements 2 to be displaced substantially at 90° with respect to the main surface of printed circuit board 9.

A journal 16 is integrally formed on central region 12 of actuating member 4. In relation to the main surface of printed circuit board 9, journal 16 protrudes perpendicularly from central region 12. Journal 16 can be actuated directly or by a handle piece to move actuating member 4 and shift the function of the electrical switch. To attach the handle piece such as a seat part, a round knob, etc., holding means such as latch projections are integrally formed on journal 16.

Journal 16 is a hollow rectangular tube suitable for displaceable receiving an actuating tappet 17 and for providing light-guiding regions. To provide light-guiding regions the hollow chamber of actuating member 4 is filled with a light-guiding body 26. Journal 16 is integrally formed on one side to central region 12. The other end of journal 16 extends out of a cross-shaped shifting gate 18 of a housing cover 19 to enable user actuation. Shifting gate 18 guides actuating member 4 so that upon actuation the actuating member is moved cross-wise from its middle neutral position into one of the four defined functional or actuating positions of the electrical switch. Malfunctions and overloads in the electrical switch are thus reliably obviated.

In order for actuating member 4 to be moved in a defined manner, the actuating member moves into the actuating positions with its spherical shaped central region 12 into correspondingly formed bearing sites of housing cover 19. In so doing, the movable contact elements 2 become tensioned as actuating regions 13 contact the movable contact elements 2. The tension causes actuating member 4 to move back into the neutral position once the force causing the actuating member is removed. This guarantees an exact, defined neutral position of actuating member 4. Housing cover 19 is provided to cover the shape of a plurality of electrical switches in an effective manner.

Figure 4:
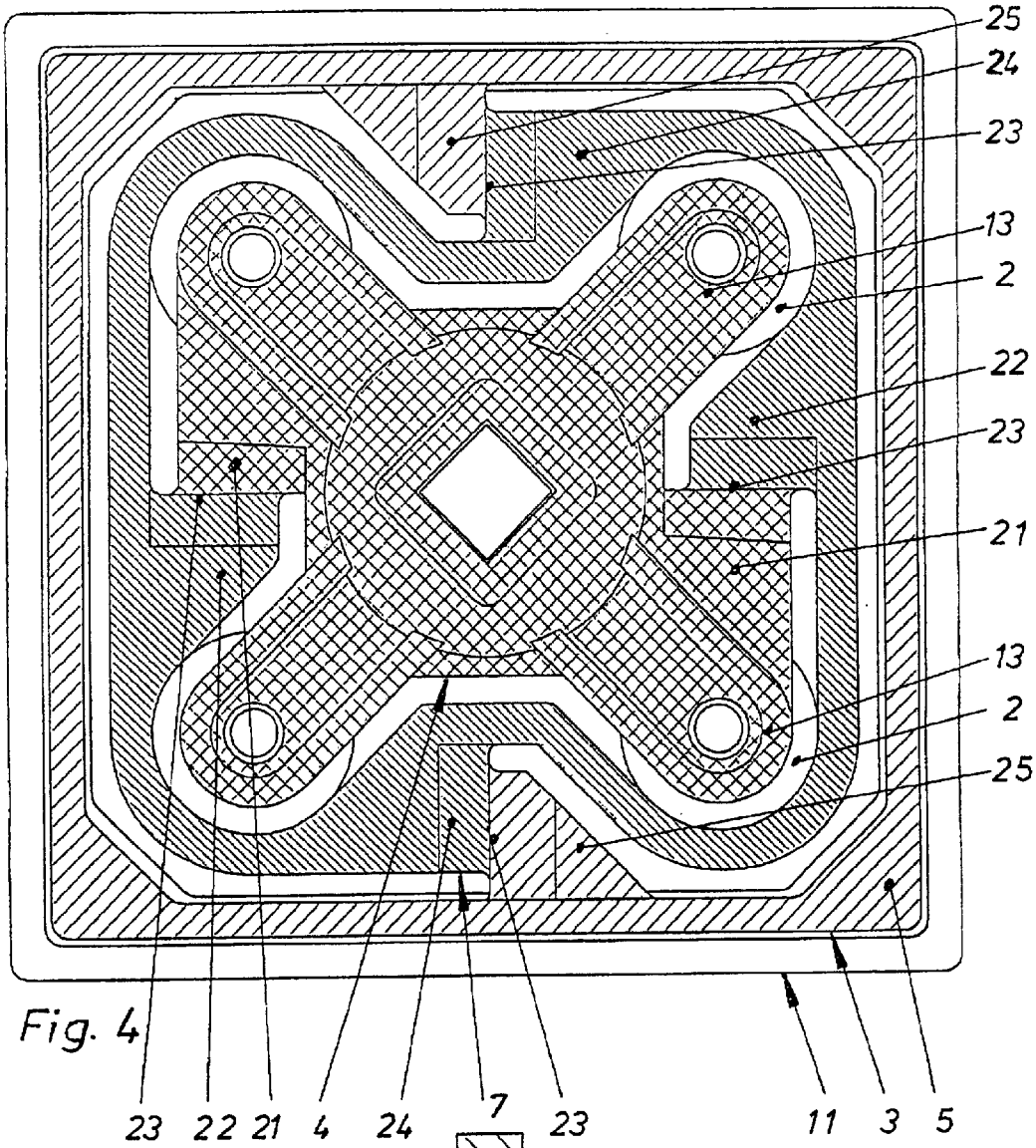
FIG. 4 illustrates an enlarged plan view of the electrical switch marking individual components with different types of shading.

Four actuating regions 13 formed as actuating arms are integrally formed on central region 12 of actuating member 4. Actuating regions 13 protrude in the shape of a cross from central region 12. Each of actuating regions 13 is associated with a respective movable contact element 2. For reinforcement, actuating regions 13 each have a U-shaped stiffening contour 20. As illustrated in FIG. 4, the first and the second connecting elements 6, 8 are formed as film-hinges.

To produce the four film-hinges, two opposite-lying, actuating regions 13 each having a triangular extension 21. Each of extensions 21 is connected as one piece to a correspondingly formed counter extension 22. Counter extension 22 protrudes in one piece from the inner region of auxiliary frame 7. Offset by 90° thereto, two extensions 24 are integrally formed similarly on the outer region of auxiliary frame 7. Extensions 24 are each connected respectively in one piece to a correspondingly formed counter extension 25. Counter extensions 25 each protrude from the inner side of housing base 5. In the direction of their hinge line 23, the material thickness of extensions 21, extensions 24, counter extensions 22, and counter extensions 25 is continuously reduced on both sides as shown in FIG. 5.

Therefore, as is particularly evident in FIG. 5, two opposite-lying, V-shaped material weaknesses are produced for each film-hinge. Four film-hinges which can be loaded continuously are thus produced conveniently. The four film-hinges connect actuating member 4, housing base 5, and auxiliary frame 7 to form a single-piece functional subassembly.

As is particularly evident in FIG. 3, the hollow chamber of journal 16 is formed as a light-guiding body 26 to illuminate a handle-piece. The handle-piece is attached to journal 16. Light-guiding body 26 can be injection-molded into the hollow chamber of journal 16 using a two-component injection-molding method.

Figure 6:
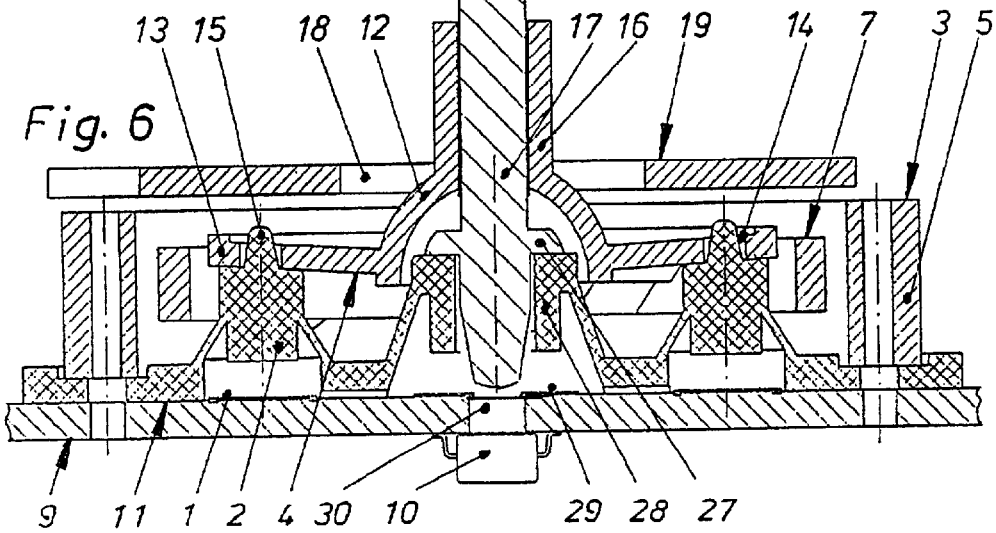
FIG. 6 illustrates a sectional view of the electrical switch in accordance with a second embodiment of the present invention.

Referring now to FIG. 6, the electrical switch in accordance with a second embodiment of the present invention is shown. The essential features of the electrical switch in accordance with the second embodiment correspond to the electrical switch in accordance with the first embodiment. Only the different characteristics will now be described in detail.

An actuating tappet 17 formed as a light-guiding element is displaceable received in the hollow chamber of journal 16. Starting from a neutral position, actuating tappet 17 can be displaced by pushing down in the direction of printed circuit board 9. An actuating collar 27 is integrally formed on actuating tappet 17 and moves into a contacting position with a movable contact element 28 when actuating tappet 17 is moved downward. Movable contact element 28 is formed as a dome switching contact and is a component of dome switching mat 11. A fixed contact element 29 associated with movable contact element 28 is provided on printed circuit board 9. Therefore, in addition to the four functional positions which are achieved by pivoting journal 16 cross-wise, the electrical switch can be moved into a fifth functional position by actuating downward actuating tappet 17.

Actuating tappet 17 is formed such that upon maximum deflection it falls with its free end region into a cut-out 30 of printed circuit board 9. This prevents actuating member 4 from being able to perform pivot movements. If actuating member 4 is pivoted into one of its other four functional positions, then the actuating tappet cannot be actuated downward. The length of actuating tappet 17 may be selected such that upon maximum deflection actuating member 4 is still able to perform pivot movements.

Actuating tappet 17 is formed as a light-guiding element to illuminate the associated handle piece. Light-emitting electronic component 10 is disposed on the main surface of printed circuit board 9 remote from actuating member 4 below cut-out 30 surrounded by fixed contact element 29.

Figure 7:
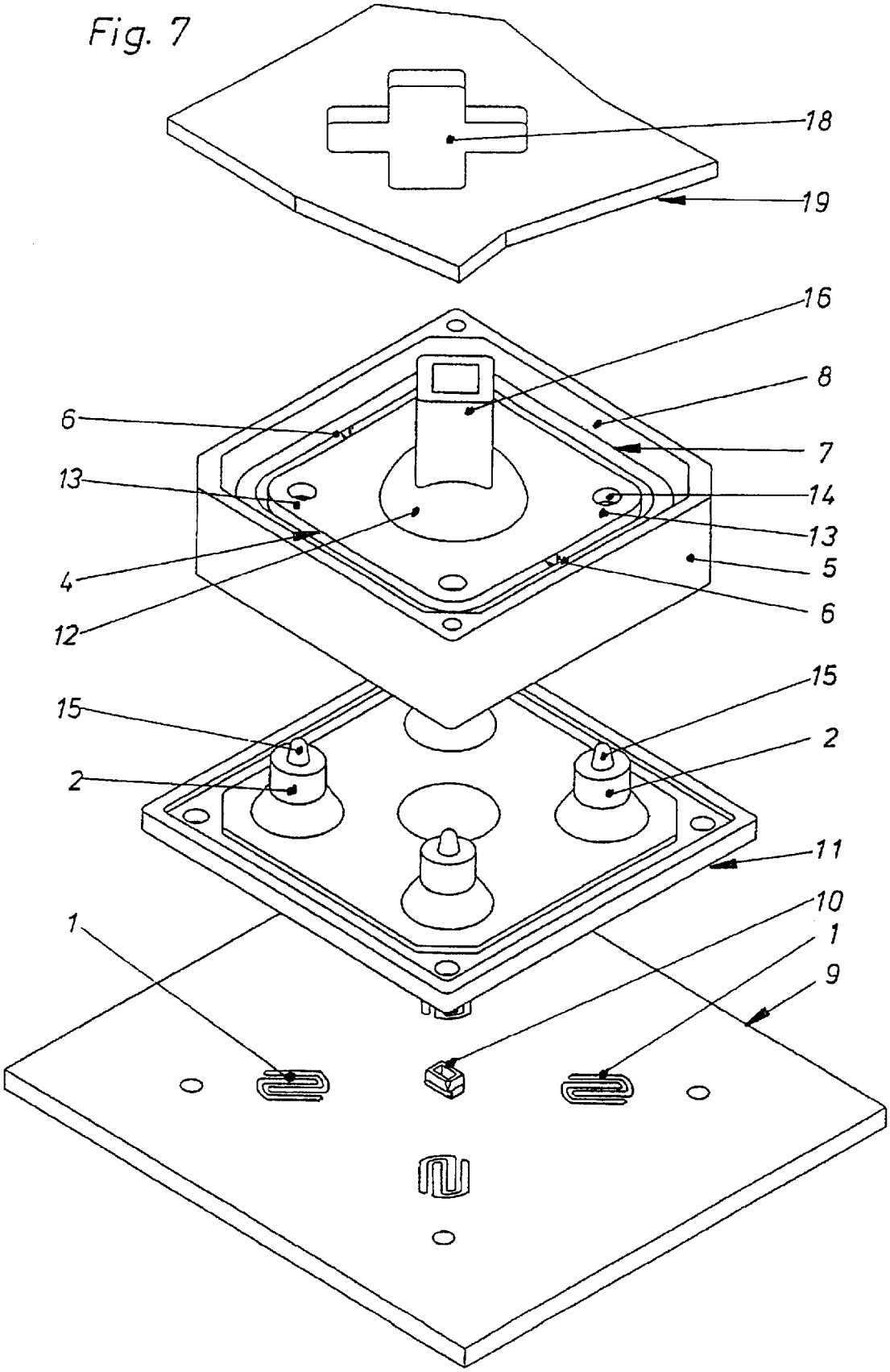
FIG. 7 illustrates an exploded view of the electrical switch in accordance with a third embodiment of the present invention.

Referring now to FIGS. 7–9, the electrical switch in accordance with a third embodiment of the present invention is shown. The four actuating regions 13 of the electrical switch in accordance with the third embodiment are integral components of an actuating plate surrounding central region 12 in one piece. The square actuating plate is integrally formed on central region 12. Each of its four free corner regions has a movable contact element 2.

As is particularly evident in FIGS. 8 and 9, the first and the second connecting elements 6, 8 are formed as rod-shaped projections having a rectangular cross-section. The first and second connecting elements 6, 8 are torsionally rotated upon displacement of actuating member 4. Each of the first and second connecting elements 6, 8 are disposed with their vertical axes transverse with respect to the direction of displacement of the actuating member for achieving a high degree of flexibility. The four connecting elements 6, 8 are each disposed offset by 45° with respect to the direction of displacement of actuating member 4. This produces a low amount of torsional loading of the four connecting elements.

The two first connecting elements 6 are integrally formed on the edge region of the actuating plate and on the inner region of auxiliary frame 7. The two second connecting elements 8 are disposed offset by 90° with respect to the two first connecting elements 6 and are integrally formed on the outer edge of auxiliary frame 7 and the inner wall of housing base 5. This produces four rod-shaped projections 6, 8 which can be torsionally loaded continuously. The four rod-shaped projections 6, 8 connect actuating member 4, housing base 5, and auxiliary frame 7 to form a single-piece functional subassembly.

Thus it is apparent that there has been provided in accordance with the present invention, an electrical switch that fully satisfies the objects, aims, and advantages set forth above. While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An electrical switch comprising:

a housing;

four fixed contact elements fixed with respect to the housing;

four movable contact elements movable with respect to the housing, each of the movable contact elements positioned directly opposite from a respective one of the four fixed contact elements;

an actuating member movable from a neutral position into four actuating positions, wherein in each one of the four actuating positions the actuating member actuates a respective one of the four movable contact elements causing the respective one of the four movable contact elements to contact a respective one of the four fixed contact elements for enabling a corresponding switching function;

an auxiliary frame surrounding the actuating member and positioned within the housing;

a first pair of opposed connecting elements integrally formed on the actuating member and the auxiliary frame connect the actuating member to the auxiliary frame, the first pair of opposed connecting elements forming a first pivot axis; and a second pair of opposed connecting elements integrally formed on the auxiliary frame and the housing connect the auxiliary frame to the housing, the second pair of opposed connecting elements disposed offset by 90° with respect to the first pair of opposed connecting elements, the second pair of opposed connecting elements forming a second pivot axis;

wherein the actuating member moves from the neutral position into one of the four actuating positions about the first and second pivot axes.

2. The electrical switch of claim 1 wherein:

at least one of the connecting elements is a rod-shaped projection.

3. The electrical switch of claim 1 wherein:

at least one of the connecting elements is a film-hinge.

4. The electrical switch of claim 1 wherein:

the fixed contact elements are disposed on a printed circuit board fixed to the housing.

5. The electrical switch of claim 1 wherein:

the housing includes a housing base and a housing cover.

6. The electrical switch of claim 1 wherein:

the first pair of connecting elements and the second pair of connecting elements are each disposed offset by 45° with respect to the four actuating positions of the actuating member.

* * * * *